United States Patent [19]

Urban

[11] Patent Number: 4,499,931

[45] Date of Patent: Feb. 19, 1985

[54] NITROGEN INJECTOR SYSTEM

[75] Inventor: Joseph Urban, Pleasantville, N.Y.

[73] Assignee: Crown Cork & Seal Company, Inc., Philadelphia, Pa.

[21] Appl. No.: 441,636

[22] Filed: Nov. 15, 1982

[51] Int. Cl.[3] ..... B65B 3/10

[52] U.S. Cl. ..... 141/67; 141/129; 141/140; 141/63; 222/399

[58] Field of Search ..... 141/4–6, 141/9, 11, 37, 63–69, 70, 100, 103, 104, 129, 141/140, 183, 192, 197, 234, 236, 250, 283, 285; 53/79, 88, 570; 222/394, 399

[56] References Cited

U.S. PATENT DOCUMENTS

| | | | |
|---|---|---|---|
| 1,361,498 | 12/1920 | Ruff | 141/5 X |
| 3,699,740 | 10/1972 | Knabe | 141/6 X |
| 4,201,319 | 5/1980 | Andera et al. | 222/399 |
| 4,407,340 | 10/1983 | Jensen et al. | 141/67 |

FOREIGN PATENT DOCUMENTS

| | | | |
|---|---|---|---|
| 408448 | 4/1934 | United Kingdom | 141/69 |
| 1455652 | 11/1976 | United Kingdom | 141/6 |

*Primary Examiner*—Stephen Marcus
*Assistant Examiner*—Ernest G. Cusick
*Attorney, Agent, or Firm*—Woodcock, Washburn, Kurtz, Mackiewicz & Norris

[57] ABSTRACT

A nitrogen injector system is provided including a nitrogen injector unit. The nitrogen injector unit includes liquid nitrogen with a head space having gaseous nitrogen at a pressure exceeding atmospheric pressure. An injector orifice is provided, as is a distributing disk which normally closes that orifice. The distributing disk is provided with metering apertures for receiving metered amounts of liquid nitrogen from a nitrogen receptacle and transporting those metered amounts to a position adjacent the injector orifice and for opening the orifice when the metered amount is in the requisite position. The pressure of nitrogen gas within the head space is utilized to eject the metered amount from the metering aperture into a container located at the dispensing position. Containers are advanced to the dispensing position on a container conveyor.

The distributing disk is rotated at a speed proportional to the speed of the container conveyor with a common drive such that a requisite amount of nitrogen will be dispensed to each container regardless of fluctuations in the speed of the conveyor.

A solenoid is provided for selectively disabling the ejection of liquid nitrogen by the disconnection of a gas discharge conduit which couples the injector orifice with the high pressure nitrogen gas within the head space.

18 Claims, 8 Drawing Figures

NITROGEN INJECTOR SYSTEM

BACKGROUND OF THE INVENTION

The present invention relates in general to machinery useful in the manufacture of beer and beverage containers, and in particular, it relates to an improved system for the insertion of liquid nitrogen into such containers at the time they are filled.

In the beer and beverage container industry, metal containers having very thin sidewalls are especially desirable because the cost of the raw materials from which those containers are made may therefore be reduced. However, the sidewall thickness of beer and beverage containers may not be decreased without limit. If the sidewall of a beer and beverage container becomes too thin, the container does not have sufficient rigidity. Such a container may dent or crumple when proceeding through the liquid filling line of a brewer or bottler for insertion of the container contents. Also, when pallet loads of filled containers are stacked one upon another, for example, in a warehouse or during transport, damage to those containers near the bottom of the pallet loads may result.

Generally, in the past, thinner walled containers could be utilized for the packaging of beer and certain carbonated beverages than could be employed with certain low or non-carbonated beverages. Since beer and carbonated beverages develop an internal pressure, that pressure is utilized to prevent inward deformation of the very thin walled container during handling. However, in the case of non-carbonated beverages or beverages having a rather low carbonation, thicker walled containers have been utilized since the internal pressure of the beverage contents may not be relied upon to aid in the provision of structural rigidity to the container itself.

To solve the foregoing difficulty in the case of beverages having low or no carbonation, liquid nitrogen injection systems have been proposed. In such systems, small quantities of liquid nitrogen are inserted into the head space at the top of a filled container. Subsequent evaporation of the liquid nitrogen after the container is filled and closed simulates the internal pressure of beer and carbonated beverages and therefore permits the use of thinner walled containers than might otherwise be employed.

In one known liquid nitrogen injection system, as filled containers pass an orifice in a can filling line, a small quantity of liquid nitrogen is dispensed into such containers by means of the opening of a solenoid controlled valve. One problem associated with this nitrogen injection system resides in the fact that the solenoid operated valve for dispensing liquid nitrogen must open and close, i.e., recycle, once for each container passing the discharge orifice. Because the speed of a can filling line may be exceedingly high, sometimes on the order of 1200 containers per minute, problems with the solenoid valve may be experienced. Problems with the solenoid activated valve for insertion of liquid nitrogen into the container may cause one of two related problems. First, an excess amount of nitrogen may be injected into a container thereby causing the container to have more than a desired internal pressure when the liquid nitrogen is vaporized. Excess pressure may cause cans to rupture, thereby causing danger to the consumer. On the other hand, if insufficent nitrogen is injected, the internal pressures developed may not be adequate to prevent deformation of thin walled containers.

Still other problems associated with known nitrogen injection systems are noticeable when the speed of a can filling line fluctuates. In those systems, can sensors are provided which sense the presence or absence of cans passing a particular point in a can filling line. Electrical circuitry in response to those can sensors opens and closes a valve for the dispensation of liquid nitrogen at a predetermined point downstream from the sensor. If the speed of the can line falls, the container sensor and logic associated therewith responds with a certain time delay. In the interim, certain containers may be over or under pressurized with obvious disadvantages.

SUMMARY OF THE INVENTION

It is an object of the present invention to provide an improved liquid nitrogen injection system which avoids the deficiencies noted in connection with other known systems of this type.

Specifically, it is an object of the present invention to provide an improved liquid nitrogen injection system which avoids the difficulties encountered from over and under pressurization caused by defective valves.

Further, it is an object of the present invention to provide a metered amount of liquid nitrogen to a container being filled which does not fluctuate with fluctuations in the speed of a can filling line.

Still further, it is an object of the present invention to provide a liquid nitrogen injector system having improved reliability over presently known systems.

SUMMARY OF THE INVENTION

These and other objects of the present invention are achieved by an improved nitrogen injector system for dispensing liquid nitrogen to a series of moving containers. The system includes a liquid nitrogen storage unit and a liquid nitrogen injector unit with a means for transferring liquid nitrogen from the storage unit to the injector unit. A container conveyor for transporting containers in a series to the injector unit is provided. The liquid nitrogen injector unit of the present invention includes a liquid nitrogen receptacle having a head space containing nitrogen in the gaseous phase. A normally closed injector orifice is provided as are means for receiving a metered amount of liquid nitrogen from the receptacle, for transporting the metered amount of liquid nitrogen to a position adjacent the injector orifice and for opening the orifice when the metered amount of liquid nitrogen is in the requisite position. In accordance with an important aspect of the present invention, a means is provided for ejecting the metered amount of liquid nitrogen through the now opened orifice by virtue of the pressure of the gaseous nitrogen in the head space.

In accordance with an important aspect of the present invention, the means for receiving a metered amount of liquid nitrogen from the nitrogen receptacle comprises a distributing disk having metering apertures radially disposed therein, the disk being rotatable with respect to the nitrogen receptacle. The injector means comprises a gas discharge conduit connected between the head space and the injector orifice such that the pressure of gaseous nitrogen in the head space may be used to eject liquid nitrogen from the metering apertures into a container to be filled.

In accordance with another important aspect of the present invention, a means for selectively disabling the ejecting means is provided. Preferably, this ejecting means comprises a solenoid responsive to a container sensor such that if there is a disruption in the flow of the containers to the nitrogen injector system, the gas discharge conduit is disconnected from the head space.

In accordance with still another important aspect of the present invention, the distributing disk is responsive to the container conveyor and preferably driven by a common drive means such that the rotational speed of the disk is proportional to the speed of the conveyor. In this manner, as the speed of a container filling line fluctuates, the speed of the liquid nitrogen dispensing system of the present invention is proportionately varied such that over or under pressurization of containers does not result.

BRIEF DESCRIPTION OF THE DRAWINGS

The present invention will be more fully understood by reference to the accompanying drawings, in which.

DETAILED DESCRIPTION OF THE PREFERRED EMBODIMENT

Figure 1:
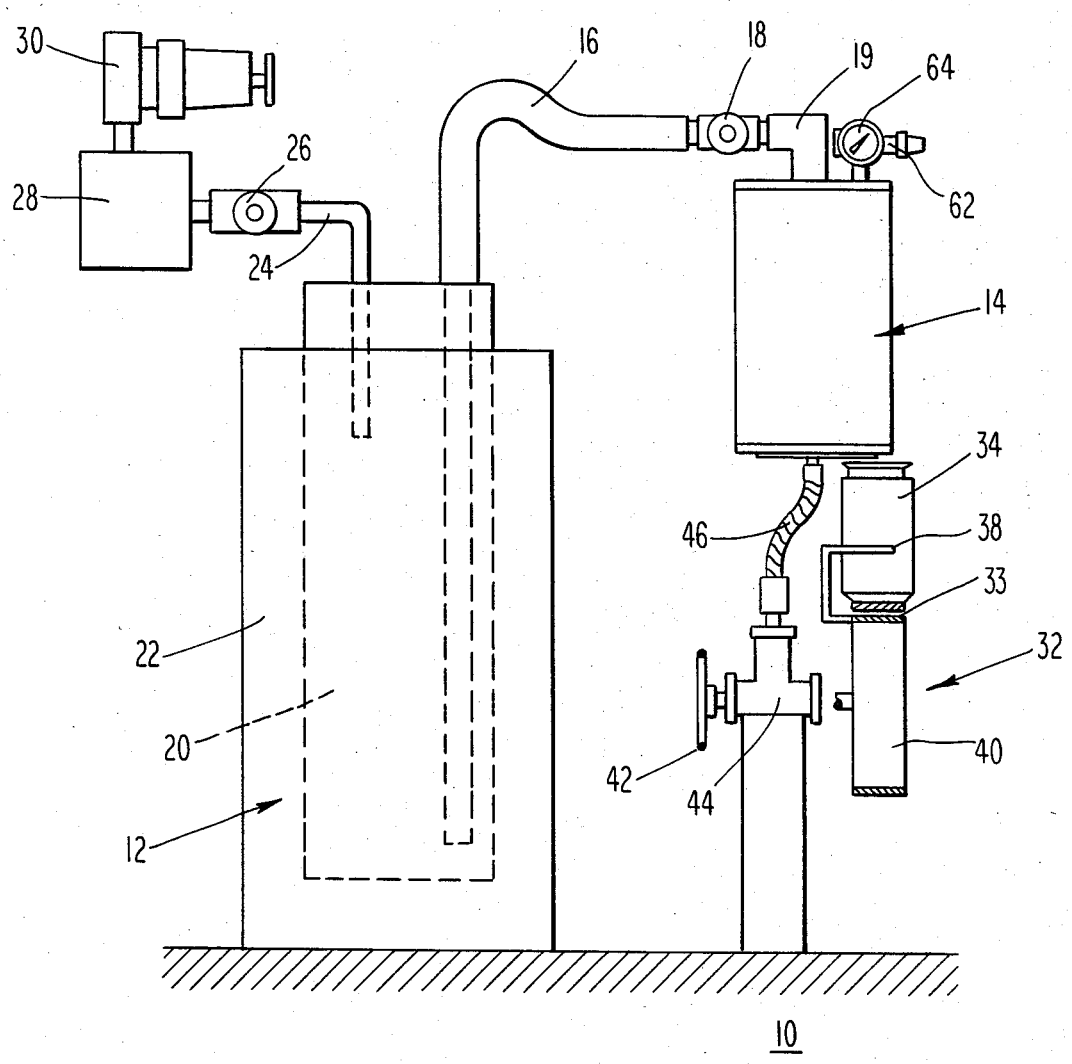
FIG. 1 is an end view of a nitrogen injector system in accordance with the present invention.

Referring now to FIG. 1, the liquid nitrogen injector system of the present invention will be seen generally at 10. The liquid nitrogen injector system of the present invention comprises a liquid nitrogen storage unit 12 and a liquid nitrogen injector unit 14. The liquid nitrogen storage and injector units 12 and 14 are interconnected by a means for transferring liquid nitrogen from the storage unit 12 to the injector unit 14, the means comprising a length of insulated tubing 16. A valve shown at 18 may also be provided intermediate the liquid nitrogen storage unit 12 and the injector unit 14 such that the flow of liquid nitrogen therebetween may be accurately controlled. A coupling 19 is provided to connect the tubing 16 and the valve 18 to the injector unit 14.

The liquid nitrogen storage unit 12 preferably comprises a tank having an inner chamber 20 containing liquid nitrogen therein which is surrounded by an outer chamber 22 providing an air insulator such that the nitrogen located in the inner chamber 20 may be maintained in the liquid phase. The liquid nitrogen storage tank of the present invention may be, for example, a container of the type sold by "MVE" Cryogenic Model VL-160L or equivalent. Connected to the liquid nitrogen storage unit 12 by means of a pipe segment 24 including a valve means 26 is a heat sink 28. The heat sink 28 is connected to a back pressure regulator 30 as shown to insure that the vapor pressure of nitrogen in the liquid nitrogen storage unit 12 is not excessive.

Figure 2:
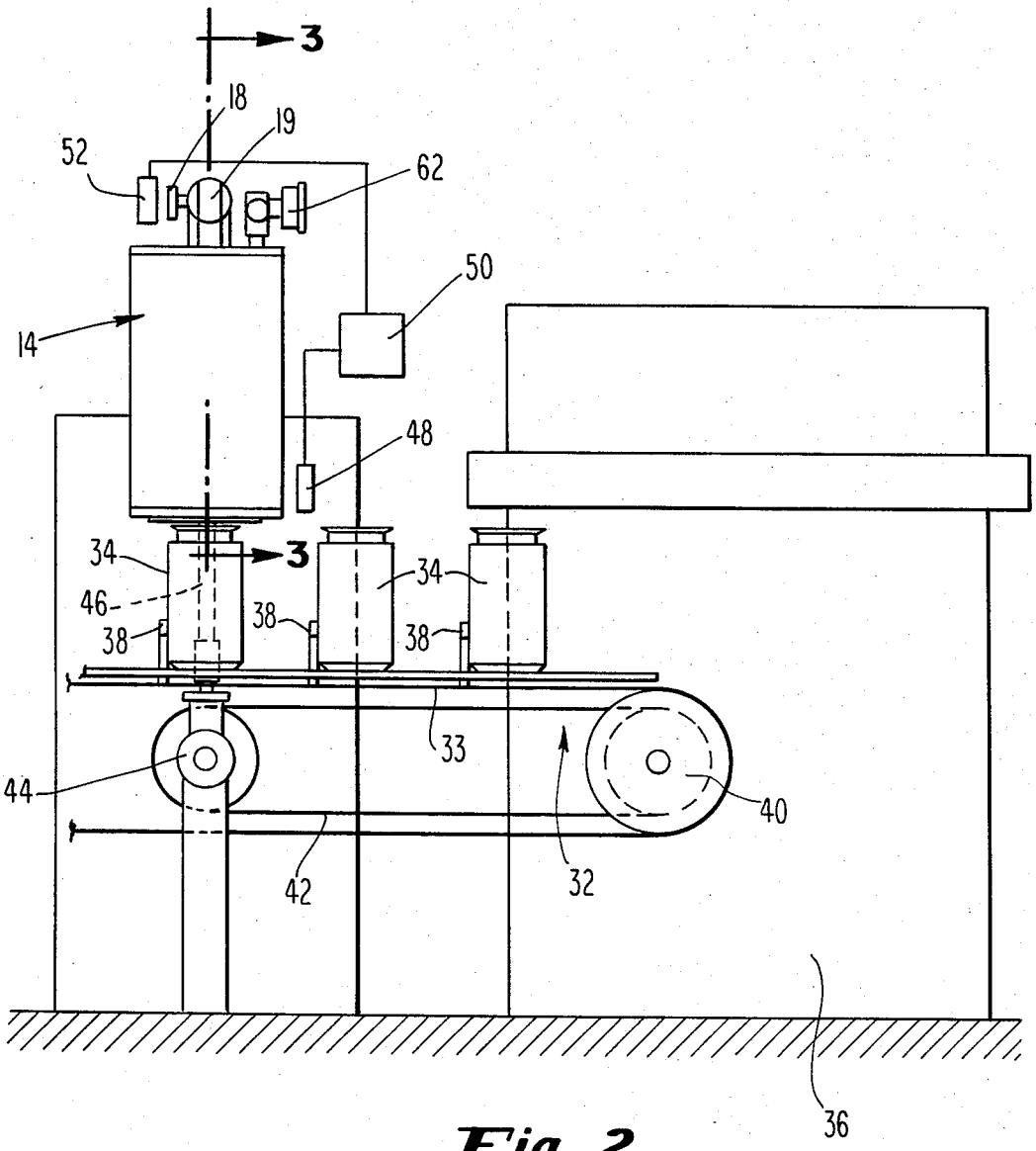
FIG. 2 is a side elevational view of the nitrogen injector system of FIG. 1.

The liquid nitrogen injector system 10 of the present invention also includes a container conveyor 32 of the type commonly utilized for transporting beverage containers 34 from a container filling machine (not shown) to a container double seamer 36 (FIG. 2). Such container conveyors may operate at speeds on the order of 1200–1500 cans per minute.

The container conveyor 32 of the present invention preferably comprises lugs 38 attached to a moving outer chain 33 which is driven by means of a pulley 40 connected to a drive means (not shown). Also connected to the pulley 40 and driven by the same drive means is an inner chain 42 which is utilized to drive a gear box 44. As shown in FIG. 1, the gear box 44 in turn drives a flexible shaft 46 which in turn drives the liquid nitrogen injector unit 14 as will be described in more detail below.

In accordance with the present invention, situated between the container filling machine and the double seamer 36 along the path of the container conveyor 32 is situated a novel liquid nitrogen injector unit 14. Referring now to FIG. 2, it will be seen that situated between the injector unit 14 and the double seamer 36 is a container sensor 48 which may, for example, be a proximity sensor which senses the presence of metal containers 34 passing beneath it. Electrical connections from the container sensor 48 are made to an electrical control and logic box 50. The container sensor 48 and control and logic box 50 are provided to detect the absence of containers passing beneath the liquid nitrogen injector unit 14. If no containers are detected by the sensor 48, the control and logic box 50 is operative to control a solenoid 52, which disables the liquid nitrogen injector unit 14 from dispensing liquid nitrogen in a manner which will be more fully set forth below. Unlike other known nitrogen injector systems in which a sensor activates an injector when containers are present, the present system deactivates the injector unit 14 when containers are absent.

Figure 3:
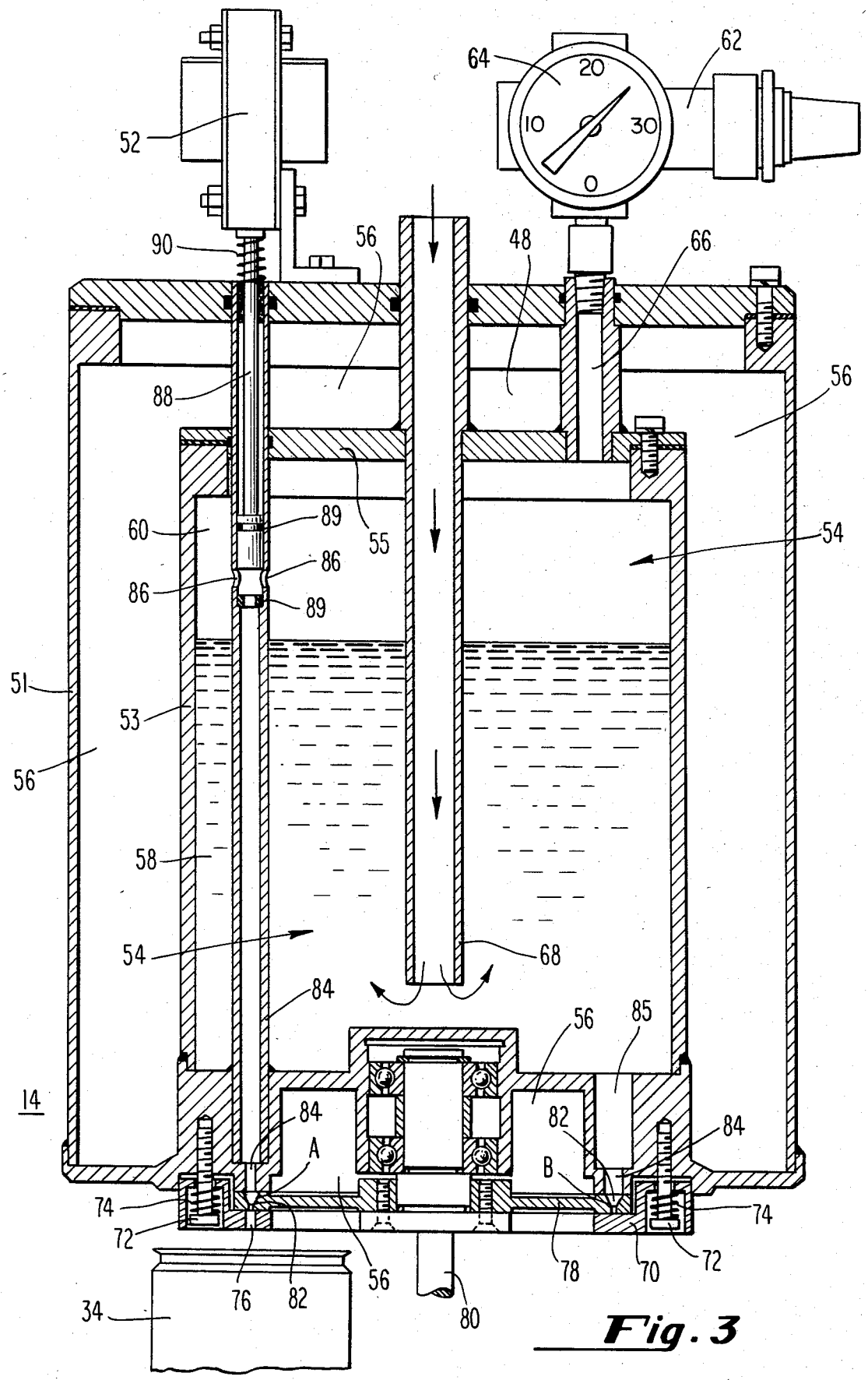
FIG. 3 is a cross-sectional view of the liquid nitrogen injector unit of the liquid nitrogen injector system of FIG. 1 taken in the direction of lines 3—3 of FIG. 2.

Referring now to FIG. 3, the liquid nitrogen injector unit 14 will be described in detail. The liquid nitrogen injector unit 14 preferably includes an outer housing 51 and an inner housing 53. The inner housing 53 and the lid 55 thereof together define a liquid nitrogen receptacle 54. The liquid nitrogen receptacle 54 is surrounded on substantially all sides by means of an air insulator space 56 between the housings 51 and 53. Situated within the liquid nitrogen receptacle 54 is found a quantity of liquid nitrogen. The liquid nitrogen receptacle 54 is divided into a first portion 58 having nitrogen therein in the liquid phase and a second portion or head space 60 having nitrogen therein in the gaseous phase. Because nitrogen has a boiling point of −320.4° F., when the liquid nitrogen injector unit 14 is at room temperature, the pressure of the gaseous phase nitrogen in the head space 60 exceeds atmospheric pressure and is typically in the range of approximately 22 pounds per square inch. To insure that the pressure of the gaseous phase nitrogen situated within the head space 60 does not become excessive, a pressure regulator valve 62 preferably having a pressure gauge 64 is provided. The pressure regulator valve 62 is connected to the head space by means of a channel 66. Liquid nitrogen from the liquid nitrogen storage tank 12 is transferred to the liquid nitrogen injector unit 14 through the insulated tubing 16 referred to above to the coupling 19 and from there through a central conduit 68 to the liquid nitrogen receptacle 54.

Situated at the bottom of the liquid nitrogen injector unit 14 is an annular face plate 70 attached to the main housing of the unit by means of a series of screws located about the periphery of the face plate 70, two of which are shown at 72. Preferably, springs 74 are provided to insure that the face plate 70 is secured to the housing in a manner so as to preclude leakage of nitrogen therefrom. Formed within the face plate 70 is an injector orifice 76 through which liquid nitrogen is dispensed to containers 34 conveyed beneath the injector unit 14 by the conveyor 32.

In accordance with an important aspect of the present invention, the injector orifice 76 is normally closed by means of a distributing disk 78 made of, for example, bronze or Teflon. The distributing disk 78 is connected to a drive shaft 80 which is in turn driven by the flexible coupling 46 referred to above. The distributing disk 78 contains metering apertures 82 therein for receiving metered amounts of liquid nitrogen from the liquid nitrogen receptacle 54. Liquid nitrogen is dispensed to the metering apertures 82 at point B from a well 85 formed in the liquid nitrogen receptacle 54, and thus, liquid nitrogen is preferably dispensed to the metering apertures 82 by gravity feed. As will be described in further detail in connection with FIG. 4 below, metering apertures 82 are radially disposed about the periphery of the distributing disk 78. The radial sectors intermediate the metering apertures 82 are such as to normally close the injector orifice 76 such that no liquid nitrogen is ordinarily dispensed. However, in accordance with the present invention, as the distributing disk 78 is rotated, a metered amount of liquid nitrogen from the well 85 is transported by the disk 78 to the position shown at point A in FIG. 3 wherein the injector orifice 76 and a metering aperture 82 are in alignment at which time the injector orifice 76 is opened.

Further in accordance with the present invention, a means is provided for ejecting the metered amount of liquid nitrogen from the metering aperture 82 positioned at point A to a container 34 by the pressure of the gaseous nitrogen located in the head space 60. The means for ejecting a metered amount of liquid nitrogen through the orifice 76 preferably comprises a gas discharge conduit 84 connected between the head space 60 and the injector orifice 76. The gas discharge conduit 84 includes holes 86 therein such that the nitrogen gas pressure within the conduit is the same as the nitrogen gas pressure in the head space 60. Thus, in accordance with a present invention, as the distributing disk 78 rotates, filled metering apertures 82 arrive at point A adjacent the injector orifice 76. Upon arrival at point A, nitrogen pressure in the head space 60 exerted through gas discharge conduit 84 is utilized to discharge a metered amount of liquid nitrogen from the metering aperture 82 located at point A into a container 34. In this manner, metered amounts of liquid nitrogen are automatically dispensed without the necessity of having a solenoid activated valve recycling once for every container. Moreover, since the distributing disk 78 is driven by a common drive means with conveyor 32, the disk 78 rotates with a peripheral speed proportional to the speed of the conveyor. Thus, it is insured that a metered amount of liquid nitrogen will be dispensed in timed relation to the speed of passage of containers 34 in the vicinity of the injector orifice 76.

Further, in accordance with the present invention, and as mentioned above, a means is provided for selectively disabling the ejection of liquid nitrogen from the injector orifice 76 when the flow of containers to the injector unit 14 has been disrupted. As mentioned above, this means includes in addition to the sensor 48 and electrical control and logic box 50, a solenoid 52. This solenoid may comprise, for example, a National Acme Company Model KK-100-BP push-type solenoid. Such a solenoid will include a plunger 88 which is normally in the retracted position shown in FIG. 3. The plunger 88 is normally retained in that retracted position by means of coil spring 90. The plunger 88 reciprocates within the gas discharge conduit 84 and in the circumstance wherein the flow of containers has been disrupted, the solenoid 52 is activated to extend the plunger 88 within the gas discharge conduit 84 to a position such that the holes 86 are closed by the plunger. When the holes are closed, leakage is precluded around the plunger by rubber seats 89. In this manner, when the holes 86 are closed, the gas discharge conduit is effectively disconnected from the head space 60 such that no liquid nitrogen will be dispensed as metering apertures pass the discharge point A adjacent the injector orifice 76. Thus, in accordance with the present invention, the solenoid 52 is activated only when the flow of containers to the injector unit 14 is disrupted, unlike in the case of other known nitrogen injector systems in which a solenoid is activated to dispense liquid nitrogen each time a container is advanced for filling.

Figure 4:
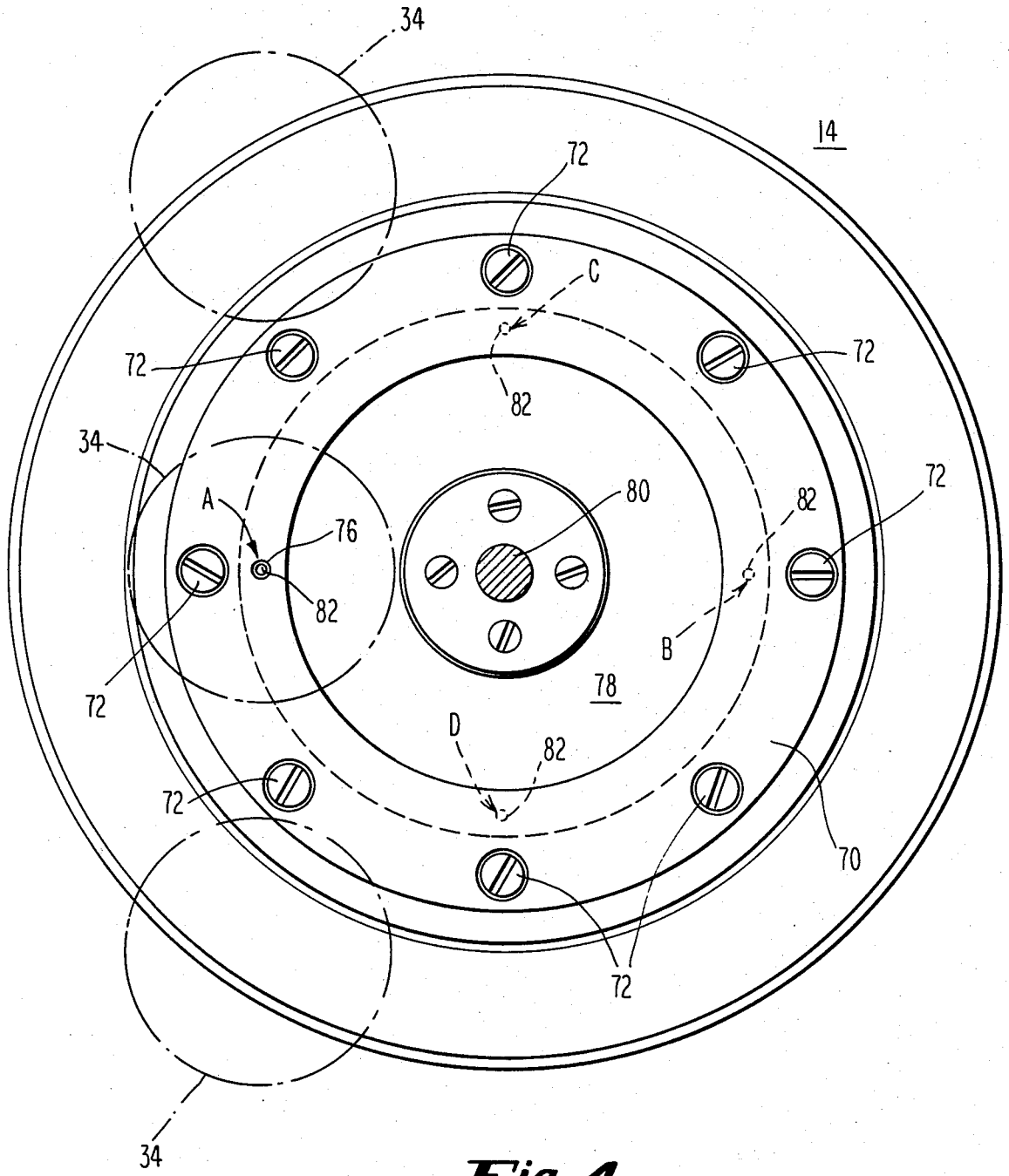
FIG. 4 is a cross-sectional view of the liquid nitrogen injector unit of FIG. 3 taken in the direction of section lines 4—4 of FIG. 3.

Referring now to FIG. 4, the relationship of the face plate 70, injector orifice 76 and metering apertures 82 will be more easily understood. In the embodiment shown in FIG. 4, a distributing disk having four metering apertures 82 is shown. The metering aperture 82 which is located at the dispensing position A directly above a container 34 is in line with the injector orifice 76 formed in the face plate 70. The metering aperture 82 located at the filling position B, however, is not in line with an aperture formed in the face plate 70. A filled metering aperture 82 is located at point C, and the liquid nitrogen found in that aperture will be dispensed to the next container arriving at the injector unit 14 is sequence. The metering aperture 82 found at point D is empty and will be the next aperture to be filled at point B. It will be understood that the circumferential distance between metering apertures 82 on the distributing disk 78 may be varied to include more than or less than four apertures, if desired.

Figure 5:
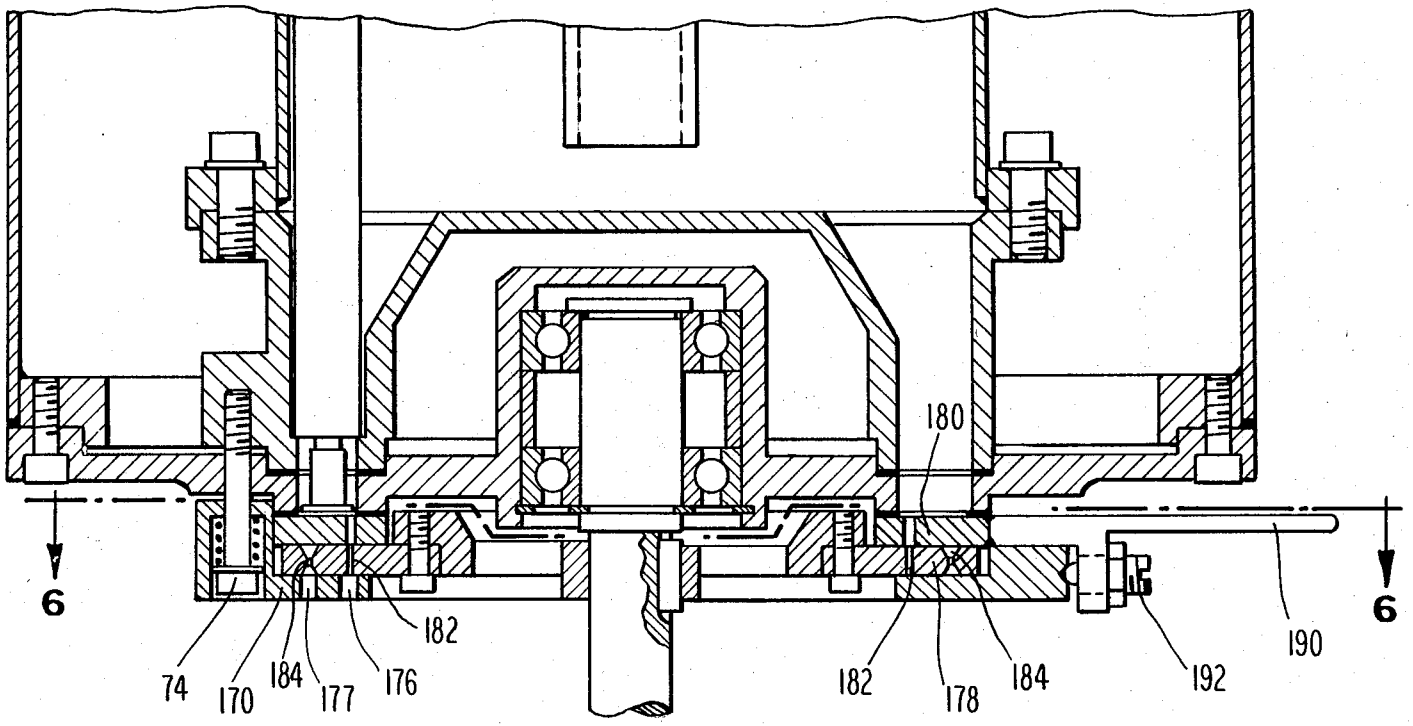
FIG. 5 is a cross-sectional view of a second embodiment of a liquid nitrogen injector unit useful in the system of FIG. 1.

Referring now to FIG. 5, a second embodiment of an injector unit useful in the system of the present invention will be described. This embodiment of the present invention is similar in many respects to the embodiment shown in FIG. 3, and thus like numerals are used to describe like elements. In this embodiment of the present invention the face plate 170 includes not one but two injector orifices 176 and 177 at the dispersing position shown at point A. In addition, the embodiment shown in FIG. 5 includes a means for varying or adjusting the quantity of liquid nitrogen injected to a given container. This means for varying the quantity of liquid nitrogen injected includes a modified distributor disk 178, including metering apertures 182 and 184 therein of differing size,and further includes a means 180 for blocking or masking selective ones of the metering apertures 182 or 184 so as to vary the quantity of liquid nitrogen dispensed therefrom. As may best be seen from FIG. 6, the improved distributing disk 178, comprises metering apertures located preferably at four radial positions of the distributing disk 178 and equally spaced about the disk. Proceeding radially outwardly along each of these radii, a first metering aperture 182 is encountered having a relatively small internal diameter. Proceeding radially outwardly further along each of these radii, a second metering aperture 184 is encountered having a relatively larger internal diameter. In accordance with this embodiment of the present invention, the blocking means 180 selectively blocks either one or the other of the metering apertures 182 or 184, or both, at the location of the injector orifice.

Figure 6:
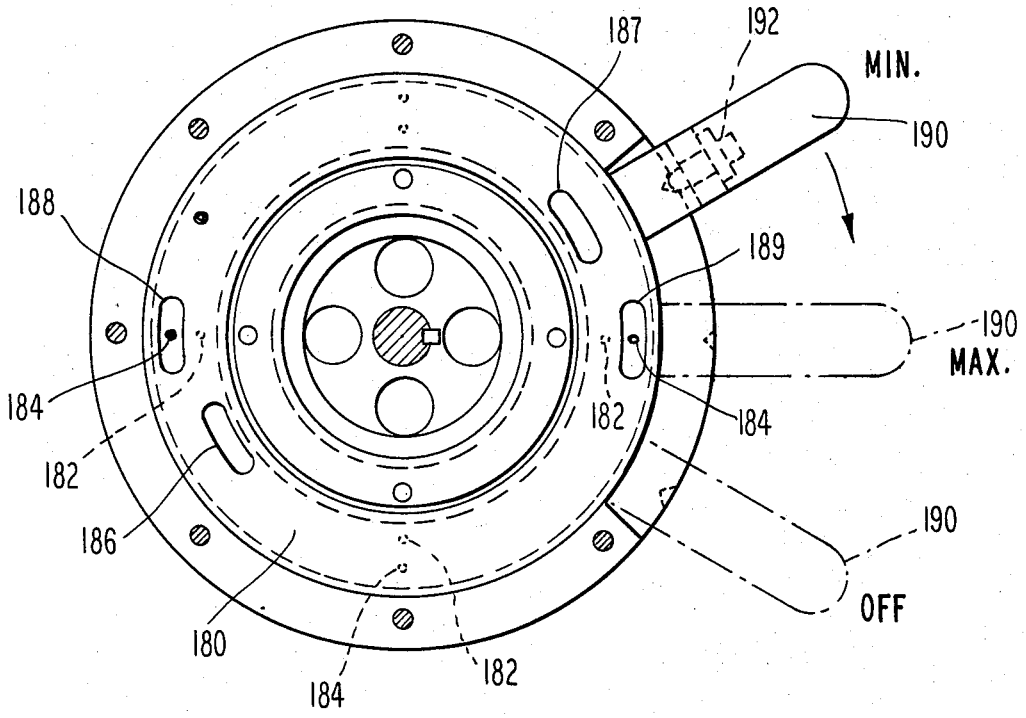
FIG. 6 is a cross-sectional view of the injector unit of FIG. 5 taken in the direction of section lines 6—6 in a full open position.

As shown in FIG. 6, this blocking means 180 includes a first slot 186 radially positioned about the masking means 180 so as to coincide with the relatively smaller diameter metering apertures 182 and further includes a second slot 188 radially positioned so as to coincide with the relatively larger diameter metering apertures 184. The masking means 180 is rotatable so as to position either one or the other of slots 186 or 188 in the vicinity of the injector orifices 176 and 177, respectively. Rotation of the blocking means 180 is accomplished by means of a projecting handle 190 integral therewith. The handle 190 is fixed in a given angular position by means of a set screw 192 which bears against the face plate 170. As shown in FIG. 6, in phantom, the handle 190 may be angularly displaced to various positions. In the embodiment shown in FIG. 6, with the handle in the angular position as shown in full, the slot 188 is poisitioned to coincide with a relatively large diameter metering aperture 184 and also with the injector orifice 177. In this position, the masking means 180 blocks the relatively small diameter metering apertures 182 as they rotate past the injector orifice 176. In this manner, a maximum quantity of liquid nitrogen may be dispensed to a passing container.

Figure 7:
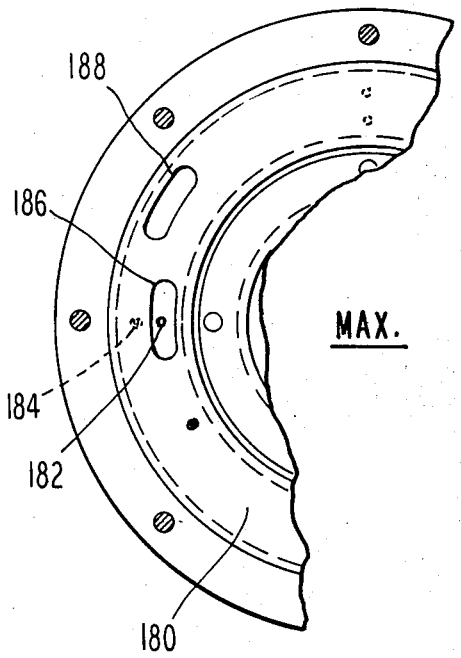
FIG. 7 is a fragmentary cross-sectional view of the injector unit of FIG. 5 in a partially open position.

Also, as shown in FIG. 6, the radial position of the handle 190 may be angularly adjusted to either a minimum or, alternatively, to an off position. As shown in FIG. 7, when the handle 190 is moved to the minimum position, the first slot 186 formed in blocking means 180 coincides with the relatively smaller internal diameter metering aperture 182 and also with the injector orifice 176. In this position the blocking means 180 blocks the injector orifice 177 and precludes the injection of liquid nitrogen from metering apertures 184.

Figure 8:
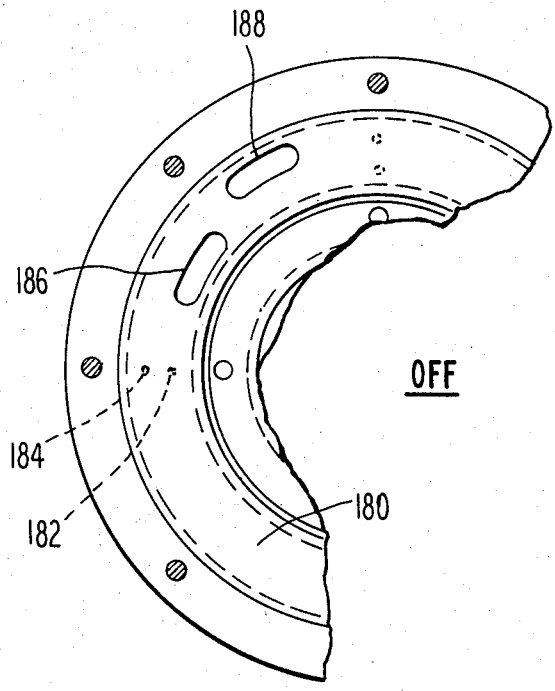
FIG. 8 is a fragmentary cross-sectional view of the injector unit of FIG. 5 in a closed position.

As shown in FIG. 8, when the handle 190 is adjusted to the off position at which neither of the slots 186 or 188 coincide with either of the injector orifices 176 or 177 so as to preclude the injection of liquid nitrogen from the liquid nitrogen injector system of the present invention.

While the present exemplary embodiment of this invention has been illustrated and described in detail, it will be recognized that this invention may be otherwise variously embodied and practiced within the scope of the following claims.

What is claimed is:

1. A liquid nitrogen injector system for dispensing liquid nitrogen to a series of moving containers of the type having:

a liquid nitrogen storage unit;

a liquid nitrogen injector unit;

a container conveyor for transporting containers in said series to said injector unit;

a means for transferring liquid nitrogen from said storage unit to said injector unit;

said injector unit comprising:

a nitrogen receptacle having a first portion for nitrogen in the liquid phase; and a second portion for nitrogen in the gaseous phase, said gaseous phase nitrogen being at a pressure exceeding atmospheric pressure;

an injector orifice;

a distributing disk having metering apertures radially disposed therein, said disk being rotatable with respect to said injector orifice, said distributing disk normally blocking said injector orifice, said apertures receiving a metered amount of liquid nitrogen from said first portion of said receptacle;

means for rotating said disk and for transporting said metered amount to a position adjacent said orifice, said orifice being unblocked when said metered amount is in said position; and ejecting means pneumatically connected to said second portion of said receptacle for ejecting said metered amount from said unblocked orifice by the pressure of said gaseous nitrogen.

2. The injector system of claim 1 wherein said ejecting means comprises a gas discharge conduit connected between said second portion of said container and said injector orifice.

3. The nitrogen injector system of claim 2 wherein:

said distributing disk is vertically disposed beneath the first portion of said nitrogen receptacle and wherein said metering apertures are filled by gravity feed.

4. The nitrogen injector system of claim 3 wherein said distributing disk is rotatable to position said filled metering apertures between said gas discharge conduit and said orifice.

5. The nitrogen injector system of claim 4 further comprising a disabling means for selectively disabling said ejecting means.

6. The nitrogen injector system of claim 5 wherein said disabling means comprises:

a solenoid operable to disconnect said gas discharge conduit from said second portion of said receptacle.

7. The nitrogen injector system of claim 6 further comprising:

a container sensor for detecting the absence of containers in said series, said solenoid responsive thereto.

8. The nitrogen injector system of claim 1 wherein said distributing disk is responsive to said container conveyor.

9. The nitrogen injector system of claim 8 wherein the rotational speed of said distributing disk is proportional to the speed of said conveyor.

10. The nitrogen injector system of claim 9 wherein said distributing disk and said container conveyor are driven by a common drive means.

11. A liquid nitrogen injector unit for dispensing liquid nitrogen to a series of moving containers comprising:

a liquid nitrogen receptacle having a head space containing nitrogen in the gaseous phase;

at least one normally blocked injector orifice;

a distributing disk having metering apertures radially disposed therein, said disk being rotatable with respect to said orifice, said apertures receiving a metered amount of liquid nitrogen from said receptacle;

means for rotating said disk and for transporting said metered amount to a position adjacent said orifice, said orifice being unblocked when said metered amount is in said position; and ejecting means for ejecting said metered amount from said unblocked orifice by the pressure of said gaseous nitrogen in said head space.

12. The injector unit of claim 11 wherein said ejecting means comprises a gas discharge conduit connected between said head space and said injector orifice.

13. The nitrogen injector unit of claim 12 wherein:

said distributing disk is disposed beneath said nitrogen receptacle and wherein said metering apertures are filled by a gravity feed.

14. The nitrogen injector unit of claim 13 wherein said distributing disk is rotatable to position said filled metering apertures between said gas discharge pressure conduit and said injector orifice.

15. The nitrogen injector unit of claim 14 further comprising:

a means for selectively disabling said ejecting means.

16. The nitrogen injector unit of claim 15 wherein said disabling means comprises:

a solenoid operable to disconnect said gas discharge conduit from said head space.

17. The nitrogen injector unit of claim 16 further comprising:

a sensor for detecting the absence of a container in said series of moving containers, said solenoid being responsive thereto.

18. The nitrogen injector unit of claim 11 further comprising:

a means for selectively varying said metered amount.

* * * * *

UNITED STATES PATENT AND TRADEMARK OFFICE

CERTIFICATE OF CORRECTION

PATENT NO. : 4,499,931

DATED : February 19, 1985

INVENTOR(S) : JOSEPH URBAN

It is certified that error appears in the above-identified patent and that said Letters Patent are hereby corrected as shown below:

Column 6, line 44, delete "is" and substitute --in-- therefor.

Column 8, line 49, after "solenoid" insert --being--.

Signed and Sealed this

*Eighteenth* Day of *June 1985*

[SEAL]

*Attest:*

DONALD J. QUIGG

*Attesting Officer* *Acting Commissioner of Patents and Trademarks*